US010247490B2

(12) United States Patent
Taylor et al.

(10) Patent No.: US 10,247,490 B2
(45) Date of Patent: Apr. 2, 2019

(54) FLOW FUNNELING INSERT AND HEAT EXCHANGER WITH FLOW FUNNELING ELEMENT

(71) Applicant: DENSO International America, Inc., Southfield, MI (US)

(72) Inventors: Dwayne Taylor, Livonia, MI (US); Sergio Pujols, Canton, MI (US); Mylissa Tinsley, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 626 days.

(21) Appl. No.: 14/820,113

(22) Filed: Aug. 6, 2015

(65) Prior Publication Data

US 2017/0038162 A1 Feb. 9, 2017

(51) Int. Cl.

| | |
|---|---|
| ***F28D 1/02*** | (2006.01) |
| ***F28F 9/02*** | (2006.01) |
| ***F28D 1/053*** | (2006.01) |

(52) U.S. Cl.

CPC ..... *F28F 9/028* (2013.01); *F28D 1/0233* (2013.01); *F28D 1/05316* (2013.01); *F28D 1/05366* (2013.01); *F28F 9/0282* (2013.01)

(58) Field of Classification Search

CPC ..... F28F 9/0268; F28F 9/0265; F28F 9/028; F28F 9/026; F28F 9/068

IPC ..... F28F 9/068

See application file for complete search history.

(56) References Cited

U.S. PATENT DOCUMENTS

| | | | | |
|---|---|---|---|---|
| 673,767 | A | 5/1901 | Eycleshymer | |
| 3,196,943 | A | 7/1965 | Haerter | |
| 8,376,029 | B2 | 2/2013 | Rericha et al. | |
| 2002/0014326 | A1 | 2/2002 | Nakado et al. | |
| 2010/0199955 | A1 | 8/2010 | Smith | |
| 2014/0166249 | A1* | 6/2014 | Goenka | F28F 9/0268 165/148 |

FOREIGN PATENT DOCUMENTS

| | | | | |
|---|---|---|---|---|
| JP | S59103089 | U | | 7/1984 |
| JP | H02133588 | U | | 11/1990 |
| JP | H03031665 | A | | 2/1991 |
| JP | 2005291643 | A | * | 10/2005 |
| JP | 2005291643 | A | | 10/2005 |
| JP | 2013249971 | A | | 12/2013 |

* cited by examiner

*Primary Examiner* — Keith Raymond
*Assistant Examiner* — Nael Babaa
(74) *Attorney, Agent, or Firm* — Harness, Dickey & Pierce, P.L.C.

(57) ABSTRACT

A heat exchanger can include a core, a first tank, and a set of guide members. The core can include a first end member, a second end member, and a plurality of tubes that can extend longitudinally between the first and second end members. The first tank can be fixedly coupled to the first end member. The first tank and first end member can define a first chamber that can be in fluid communication with a first port of the first tank and a first end of the tubes. The set of guide members can be coupled to the first end member. The set of guide members can cooperate to define a plurality of first funnels. A narrow end of each first funnel can be open to an individual one of the tubes. A wide end of each first funnel can be open to the first chamber.

7 Claims, 4 Drawing Sheets

FLOW FUNNELING INSERT AND HEAT EXCHANGER WITH FLOW FUNNELING ELEMENT

FIELD

The present disclosure relates to flow funneling inserts for heat exchangers and heat exchangers having a flow funneling element.

BACKGROUND

This section provides background information related to the present disclosure which is not necessarily prior art.

Heat exchangers such as those used to cool internal combustion engines typically include a core, an inlet tank, and an outlet tank. The inlet tank includes an inlet port and is fixedly mounted to a first side of the core to define an inlet reservoir. The outlet tank includes an outlet port and is fixedly mounted to a second side of the core to define an outlet reservoir. The core includes a plurality of tubes that extend between the first and second sides of the core to fluidly couple the inlet and outlet reservoirs. Typically a plurality of fins extend between the tubes to aid in transferring heat from a fluid (e.g. coolant fluid) flowing through the tubes to a fluid (e.g. air) flowing between the tubes.

In some applications, the tubes extend freely into the inlet and outlet reservoirs. In other applications, the tubes terminate abruptly at an end plate of the core. These abrupt transitions from the relatively large volume of the inlet and outlet reservoirs into and from the tubes can result in large pressure drops across the heat exchanger.

SUMMARY

This section provides a general summary of the disclosure, and is not a comprehensive disclosure of its full scope or all of its features.

The present teachings provide for a heat exchanger including a core body, a first tank, a second tank, and a first set of guide members. The core body can include a first end member, a second end member, and a plurality of tubes that can extend longitudinally between the first and second end members. The first tank can be fixedly coupled to the first end member. The first tank can include a first port. The first tank and first end member can define a first chamber that can be in fluid communication with the first port and a first end of the tubes. The second tank can be fixedly coupled to the second end member. The second tank can include a second port. The second tank and second end member can define a second chamber that can be in fluid communication with the second port and a second end of the tubes. The first set of guide members can be coupled to the first end member. The first set of guide members can cooperate to define a plurality of first funnels. The narrow end of each first funnel can be open to an individual one of the tubes. The wide end of each first funnel can be open to the first chamber.

The present teachings further provide for an insert for a heat exchanger that has a first tank, a second tank, and a core including a plurality of tubes that can extend between the first and second tanks. The insert can include a main body. The main body can define a plurality of funnels. The main body can be configured to be received within the heat exchanger between the first tank and the core. Each of the funnels can be configured to align with one of the tubes and can expand from a narrow aperture proximate to one of the tubes to a wide aperture proximate to the tank to fluidly couple the tubes to the tank.

The present teachings further provide for an insert for a heat exchanger that has a first tank, a second tank, and a core including a plurality of tubes that can extend between the first and second tanks. The insert can include a main body. The main body can include a plurality of guide members that can be configured to be received within the heat exchanger between the first tank and the core. Adjacent guide members can cooperate to define a funnel that has a narrow aperture that opens into one of the tubes, and a wide aperture that opens into the tank to fluidly couple the tubes to the tank. A distance between the narrow aperture and the wide aperture can increase with decreased proximity to an inlet/outlet of the first tank.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are directed to a heat exchanger assembly having improved flow of a cooling fluid (e.g. coolant, air, water) through a core of the heat exchanger assembly. The heat exchanger assembly of the present teachings can be used in any heat exchanger application where the cooling fluid flows from an intake tank, through a plurality of tubes, and to an outlet tank. One non-limiting example of such a heat exchanger application is a radiator of an internal combustion engine's cooling system.

Figure 1:
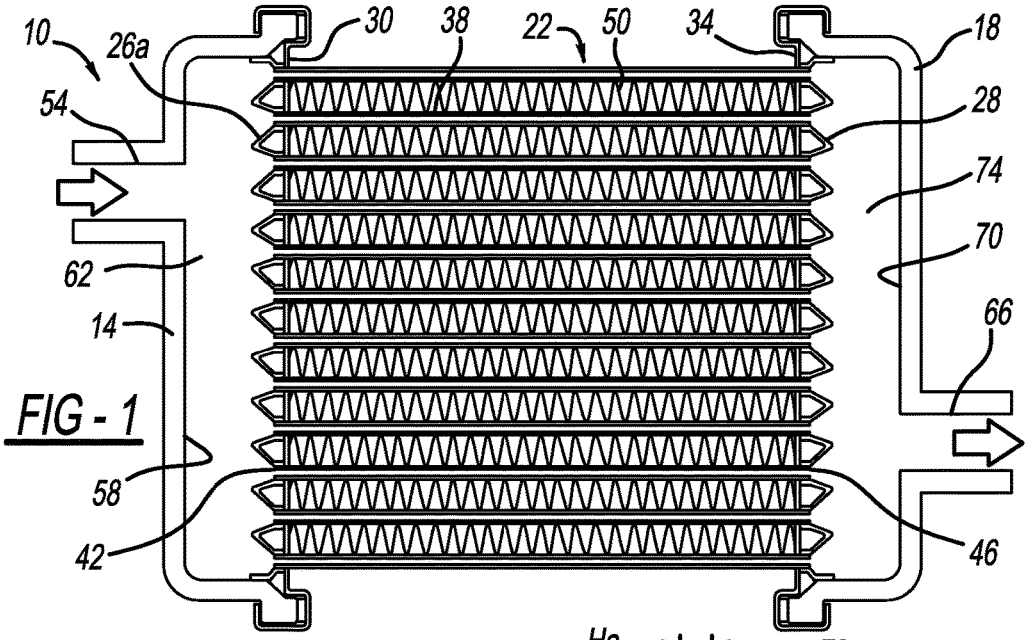
FIG. 1 is a sectional view of an example of a heat exchanger assembly in accordance with the present disclosure.

FIG. 1 illustrates a sectional view of a heat exchanger 10. The heat exchanger can be used to transfer heat between two fluids in any suitable application, such as a vehicle radiator for example. The heat exchanger 10 can generally include a first tank 14, a second tank 18, a core 22, and a plurality of first flow guides 26. In the example provided, the heat exchanger 10 also includes a plurality of second flow guides 28. In an alternative construction, not specifically shown, the heat exchanger 10 can include only the first flow guides 26 and not the second flow guides 28, or can include only the second flow guides 28 and not the first flow guides 26.

The core 22 can have a first end member 30, a second end member 34, and a plurality of tubes 38 that can be fixedly coupled to the first and second end members 30, 34 and can extend therebetween. The tubes 38 can be open at both terminal ends 42 and 46 of the tubes 38. The tubes 38 can be constructed of a thermally conductive material, such as metal for example. In the example provided, a plurality of thermally conductive fins 50 can be fixedly coupled to and extend between the tubes 38 to aid in dissipating heat from the tubes 38.

The first tank 14 can have a first port 54 and a first inner wall 58. The first tank 14 can be fixedly coupled to the first end member 30 such that the first inner wall 58 and the first end member 30 define a first fluid chamber 62. The first port 54 can be in fluid communication with the first fluid chamber 62. In the example provided, the first port 54 can be an inlet port configured to permit fluid communication of a first fluid (not specifically shown; e.g. a liquid coolant such as ethylene glycol or water) from another element of a cooling system (not shown; e.g. an engine or a coolant pump) to the first fluid chamber 62.

While the example heat exchanger 10 is illustrated as having the inlet and outlet tanks 14, 18 on opposite sides of the core 22, other configurations can be used. For example, the inlet and outlet tanks can be located on the same side of the core. In one such a configuration, the tubes of the core can be bent or curved (e.g. in a U-turn configuration) to return to the outlet tank on the same side as the inlet tank. In another such configuration, an intermediate tank can be located opposite from the inlet and outlet tanks. In such a configuration, fluid can flow from the inlet tank, through a first set of the tubes of the core, and the intermediate tank can direct fluid from the first set of tubes through a second set of tubes and back to the outlet tank.

While the example heat exchanger 10 is illustrated as having a single inlet port (e.g. first port 54) and a single outlet port (e.g. second port 66), other configurations can be used. For example, the inlet tank 14 and/or the outlet tank 18 can include additional ports.

The second tank 18 can have a second port 66 and a second inner wall 70. The second tank 18 can be fixedly coupled to the second end member 34 such that the second inner wall 70 and the second end member 34 define a second fluid chamber 74. The tubes 38 can extend through the first and second end members 30, 34 to fluidly couple the first fluid chamber 62 with the second fluid chamber 74. In the example provided, the tubes 38 can extend through the first and second end members 30, 34, such that the terminal ends 42, 46 of the tubes 38 extend respectively into the first and second fluid chambers 62, 74, though other configurations can be used (e.g. the terminal ends 42, 46 can be substantially flush with the first and second end members 30, 34, respectively). The second port 66 can be fluidly coupled to the second fluid chamber 74. In the example provided, the second port 66 can be an outlet port configured to permit fluid communication of the first fluid from the second fluid chamber 74 to another element of the cooling system (not shown; e.g. an engine or a coolant pump) to receive heat therefrom.

Thus, fluid can generally receive heat, for example, from the engine, flow into the heat exchanger 10 through the first port 54, lose heat to a second fluid (e.g. air) that flows across the tubes 38, and exit the heat exchanger 10 through the second port 66 to return to the engine.

The first flow guides 26 can be fixedly coupled to the first end member 30 and can extend into the first fluid chamber 62. The first flow guides 26 can be configured to direct the first fluid (not specifically shown) from the first fluid chamber 62, into the tubes 38. The second flow guides 28 can be fixedly coupled to the second end member 34 and can extend into the second fluid chamber 74. The second flow guides 28 can be configured to direct the first fluid (not specifically shown) from the tubes 38, into the second fluid chamber 74. While the flow guides 26, 28 are illustrated as being located along the entire height of the core (i.e. the flow guides 26, 28 direct the first fluid to and from each of the tubes 38), other configurations can be used. For example, some tubes 38 can include a flow guide 26, 28, while others can be configured without a corresponding flow guide 26, 28. The first and second flow guides 26, 28 are described in greater detail below.

Figure 2:
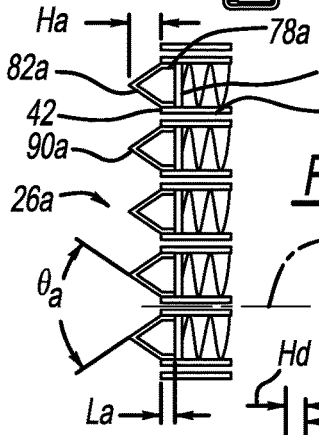
FIG. 2 is a sectional view of a portion of the heat exchanger assembly of FIG. 1, illustrating flow guides of a first construction.

With additional reference to FIG. 2, a portion of the heat exchanger 10 is illustrated in greater detail including a plurality of first flow guides 26 of a first construction, which are denoted by reference numeral **26*a*. While FIG. 2 illustrates a portion of the first flow guides 26*a*, the first end member 30, and the terminal ends 42 of the tubes 38, it is understood that the second flow guides 28 (FIG. 1), the second end member 34 (FIG. 1), and the terminal ends 46 (FIG. 1) can be constructed similarly to any of the configurations described below. Accordingly, only the first flow guides 26*a*, the first end member 30, and the terminal ends 42 will be described in detail. It is understood that the first and second flow guides 26*a*, 28 (FIG. 1) can be constructed differently from one another. In other words, the first flow guides 26 can be constructed of one type of configuration described below, while the second flow guides 28 (FIG. 1**) can be constructed of a different type of configuration described below.

The first flow guides **26*a* can have a base portion 78*a* and a funnel portion 82*a*. The base portion 78*a* can be fixedly coupled to the first end member 30 between adjacent tubes 38 or can be fixedly coupled to adjacent tubes 38. The base portion 78***a* can be fixedly coupled thereto in any suitable manner such as by brazing, welding, adhesive, fasteners, or press-fit for example. The base portion 78*a* can extend outward from the first end member 30 generally parallel to a longitudinal axis 86 of the tubes 38 by a distance La from the first end member 30. In the example provided, the distance La is substantially equal to the distance that the tubes 38 extend into the first fluid chamber 62 from the first end member 30, though other configurations can be used such as those described below. In the example provided, the distance La can be the same for each first flow guide 26*a*, though other configurations can be used such as those described below.

The funnel portion 82*a* can extend from opposite sides of the base portion 78*a* by a distance Ha and can be angled to form a peak 90*a*. In the example provided, the distance Ha can be the same for each first flow guide 26*a*, though other configurations can be used such as those described below. Opposing sides of adjacent funnel portions 82*a* can generally form a funnel having a total funnel angle of θa such that the funnel narrows toward the base portion 78*a* (i.e. toward the terminal end 42 of the tubes 38) and widens with increasing distance from the base portion 78*a*. In the example provided, the total funnel angle θa can be bisected by the longitudinal axis 86 such that equal halves of the total funnel angle θa are on both sides of the longitudinal axis 86 of the corresponding tube 38, though other configurations can be used such as those described below. In the example provided, the total funnel angle θa can be the same between all adjacent first flow guides 26*a*, though other configurations can be used such as those described below.

Figure 3:
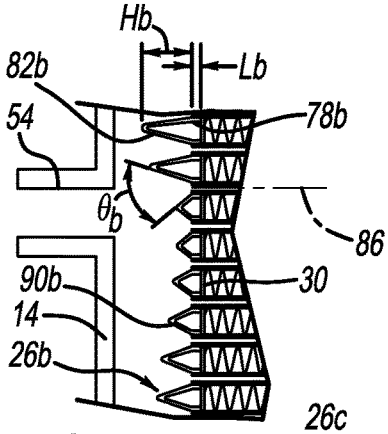
FIG. 3 is a sectional view of a portion of the heat exchanger assembly of FIG. 1, illustrating flow guides of a second construction.

With additional reference to FIG. 3, a plurality of first flow guides 26*b* of a second construction are illustrated. The first flow guides 26*b* can be similar to the first flow guides 26*a* (FIGS. 1 and 2) except as otherwise shown or described herein. Accordingly, similar reference numerals between FIGS. 1, 2 and 3 denote similar elements, except as otherwise shown or described herein.

In the example provided, base portion 78*b* of the first flow guides 26*b* can extend outward from the first end member 30 generally parallel to the longitudinal axis 86 by a distance Lb that can be similar to distance La (FIG. 2). Funnel portion 82*b* can extend from opposite sides of the base portion 78*b* by a distance Hb and can be angled to form peak 90*b*. The distance Hb of each first flow guide 26*b* can be different depending on position relative to the first port 54. In the example provided, the distance Hb generally increases with increased distance from the first port 54, though other configurations can be used.

Opposing sides of adjacent funnel portions 82*b* can generally form a funnel having a total funnel angle of θb similar to θa (FIG. 2). The total funnel angle θb can be the same between all adjacent first flow guides 26*b*, and can be generally bisected by the longitudinal axis 86 though other configurations can be used such as those described below.

Figure 4:
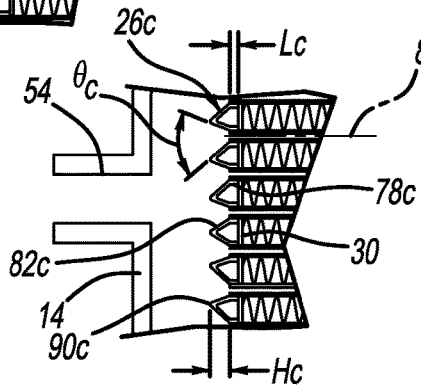
FIG. 4 is a sectional view of a portion of the heat exchanger assembly of FIG. 1, illustrating flow guides of a third construction.

With additional reference to FIG. 4, a plurality of first flow guides 26*c* of a third construction are illustrated. The first flow guides 26*c* can be similar to the first flow guides 26*a*, 26*b* (FIGS. 1-3) except as otherwise shown or described herein. Accordingly, similar reference numerals between FIGS. 1-4 denote similar elements, except as otherwise shown or described herein.

In the example provided, base portion 78*c* of the first flow guides 26*c* can extend outward from the first end member 30 generally parallel to the longitudinal axis 86 by a distance Lc that can be similar to distances La or Lb (FIGS. 2 and 3). Funnel portion 82*c* can extend from opposite sides of the base portion 78*c* by a distance Hc and can be angled to form peak 90*c*. In the example provided, the distance Hc can be similar to distance Ha (FIG. 2) such that the distance Hc is the same for all of the first flow guides 26*c*. In an alternative construction, not specifically shown, Hc can be similar to Hb (FIG. 3) such that Hc can vary with distance from the first port 54.

Opposing sides of adjacent funnel portions 82*c* can generally form a funnel having a total funnel angle of θc. The opposing sides of adjacent funnel portions 82*c* can be different lengths such that the funnel can be skewed. In the example provided, the opposing sides of adjacent funnel portions 82*c* can be angled such that the total funnel angle θc can be skewed or angled generally toward the first port 54. In other words, the total funnel angle θc can be unequally divided by the longitudinal axis 86, and the greater portion of the total funnel angle θc can be proximal to the first port 54. In the example provided, the proportion of the total funnel angle θc that is proximate to the first port 54 can increase with increased distance from the first port 54. The total funnel angle θc can also be a different overall angle depending on location relative to the first port 54.

Figure 5:
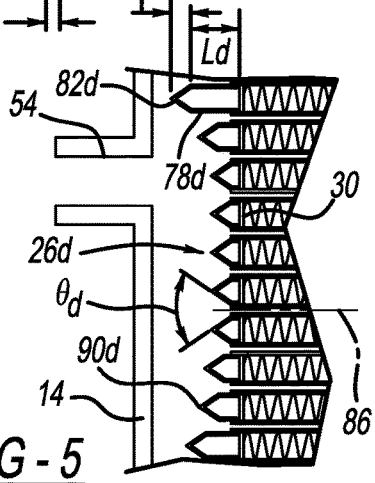
FIG. 5 is a sectional view of a portion of the heat exchanger assembly of FIG. 1, illustrating flow guides of a fourth construction.

With additional reference to FIG. 5, a plurality of first flow guides 26*d* of a fourth construction are illustrated. The first flow guides 26*d* can be similar to the first flow guides 26*a*-26*c* (FIGS. 1-4) except as otherwise shown or described herein. Accordingly, similar reference numerals between FIGS. 1-5 denote similar elements, except as otherwise shown or described herein.

In the example provided, base portion 78*d* of the first flow guides 26*d* can extend outward from the first end member 30 generally parallel to the longitudinal axis 86 by a distance Ld. The distance Ld of each first flow guide 26*d* can be different depending on position relative to the first port 54. In the example provided, the distance Ld generally increases with increased distance from the first port 54, though other configurations can be used.

Funnel portion 82*d* can extend from opposite sides of the base portion 78*d* by a distance Hd and can be angled to form peak 90*d*. In the example provided, the distance Hd can be similar to distance Ha (FIG. 2) such that the distance Hd is the same for all of the first flow guides 26*d*. In an alternative construction, not specifically shown, Hd can be similar to Hb (FIG. 3) such that Hd can also vary with distance from the first port 54.

Opposing sides of adjacent funnel portions 82*d* can generally form a funnel having a total funnel angle of θd similar to θa (FIG. 2). The total funnel angle θd can be the same between all adjacent first flow guides 26*d*, and can be generally bisected by the longitudinal axis 86 though other configurations can be used. In an alternative construction, not specifically shown, the funnel portions 82*d* can be constructed similarly to the funnel portions 82*c* such that the directionality and/or the overall angle of the total funnel angle θd can vary with location relative to the first port 54.

Figure 6:
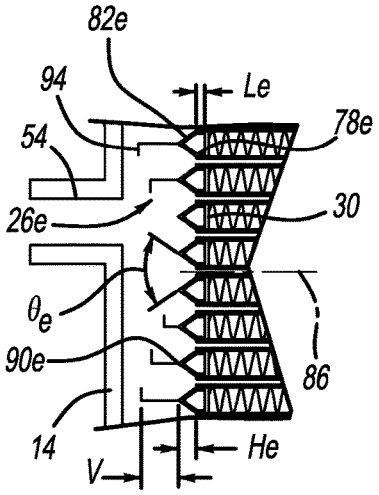
FIG. 6 is a sectional view of a portion of the heat exchanger assembly of FIG. 1, illustrating flow guides of a fifth construction.

With additional reference to FIG. 6, a plurality of first flow guides 26*e* of a fifth construction are illustrated. The first flow guides 26*e* can be similar to the first flow guides 26*a*-26*d* (FIGS. 1-5) except as otherwise shown or described herein. Accordingly, similar reference numerals between FIGS. 1-6 denote similar elements, except as otherwise shown or described herein.

In the example provided, base portion 78*e* of the first flow guides 26*e* can extend outward from the first end member 30 generally parallel to the longitudinal axis 86 by a distance Le that can be similar to distance La (FIG. 2). In an alternative construction, not specifically shown, the distance Le can be similar to distance Ld such that distance Le can vary with location relative to the first port 54.

Funnel portion 82*e* can extend from opposite sides of the base portion 78*e* by a distance He and can be angled to form peak 90*e*. In the example provided, the distance He can be similar to distance Ha (FIG. 2) such that the distance He is the same for all of the first flow guides 26*e*. In an alternative construction, not specifically shown, He can be similar to Hb (FIG. 3) such that He can vary with distance from the first port 54.

Opposing sides of adjacent funnel portions 82*e* can generally form a funnel having a total funnel angle of θe similar to θa (FIG. 2). The total funnel angle θe can be the same between all adjacent first flow guides 26*e*, and can be generally bisected by the longitudinal axis 86 though other configurations can be used. In an alternative construction, not specifically shown, the funnel portions 82*e* can be constructed similarly to the funnel portions 82*c* such that the directionality and/or the overall angle of the total funnel angle θe can vary with location relative to the first port 54.

In the example provided, some of the first flow guides 26*e* can also include a plurality of vanes 94. Each vane 94 can be fixedly coupled to one of the peaks 90*e* and can extend from the peak 90*e* generally away from the first end member 30 by a distance V. The distance V can increase with increased distance from the first port 54, though other configurations can be used. The vanes 94 can curve generally toward the first port 54 to direct flow of the first fluid (not specifically shown) from the first port 54. It is understood that the size, location, and shape of the vanes 94 can be determined based on desired flow characteristics. In the example provided, the first flow guides 26*e* that are proximate to the first port 54 are configured to not have vanes 94, while the first flow guides 26*e* that are further from the first port 54 include the vanes 94, though other configurations can be used.

Figure 7:
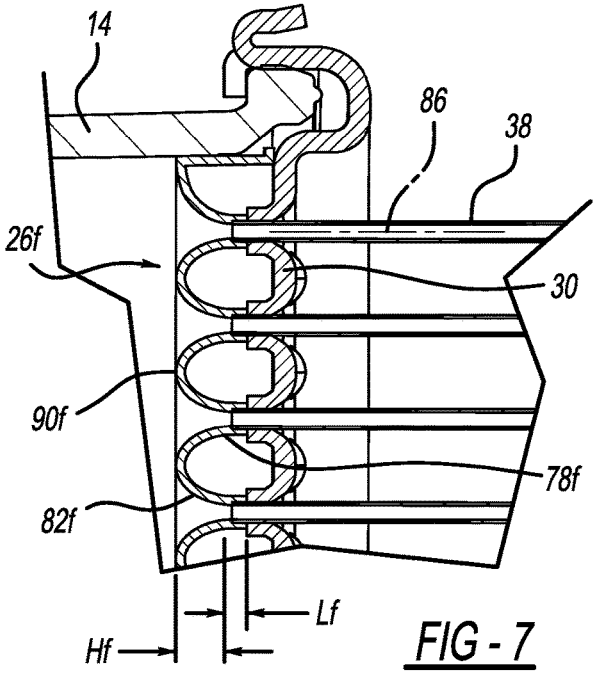
FIG. 7 is a sectional view of a portion of the heat exchanger assembly of FIG. 1, illustrating flow guides of a sixth construction.

With additional reference to FIG. 7, a plurality of first flow guides 26*f* of a sixth construction are illustrated. The first flow guides 26*f* can be similar to the first flow guides 26*a*-26*e* (FIGS. 1-6) except as otherwise shown or described herein. Accordingly, similar reference numerals between FIGS. 1-7 denote similar elements, except as otherwise shown or described herein.

In the example provided, base portion 78*f* of the first flow guides 26*f* can extend outward from the first end member 30 generally parallel to the longitudinal axis 86 by a distance Lf that can be similar to distance La (FIG. 2). In an alternative construction, not specifically shown, the distance Lf can be similar to distance Ld such that distance Lf can vary with location relative to the first port 54 (shown in FIGS. 1-6).

Funnel portion 82*f* can extend from opposite sides of the base portion 78*f* by a distance Hf and can be curved to form peak 90*f*. In the example provided, the distance Hf can be similar to distance Ha (FIG. 2) such that the distance Hf is the same for all of the first flow guides 26*f*. In an alternative construction, not specifically shown, Hf can be similar to Hb (FIG. 3) such that Hf can vary with distance from the first port 54 (shown in FIGS. 1-6). In the example provided, the funnel portion 82*f* can be curved in a generally elliptical or ovoid shape, though other configurations can be used. Opposing sides of adjacent funnel portions 82*f* can generally form a funnel that can expand with increased distance from the first end member 30. While not specifically shown, the first flow guides 26*f* can also include a plurality of vanes similar to vanes 94 (FIG. 6).

Figure 8:
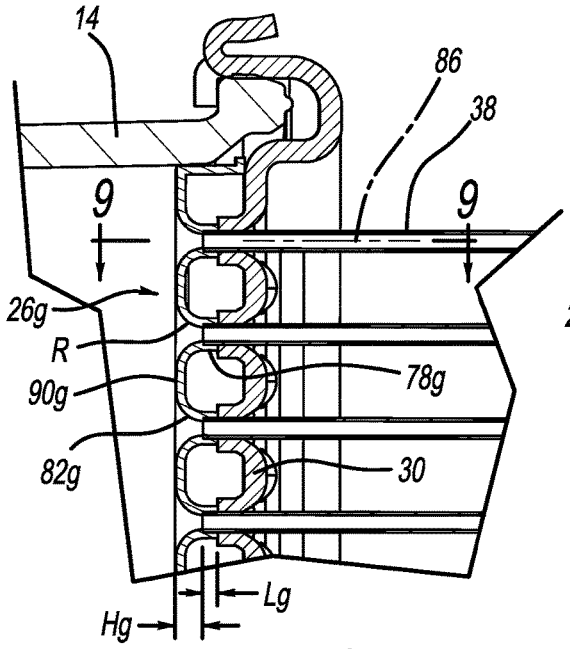
FIG. 8 is a sectional view of a portion of the heat exchanger assembly of FIG. 1, illustrating flow guides of a seventh construction.
Figure 9:
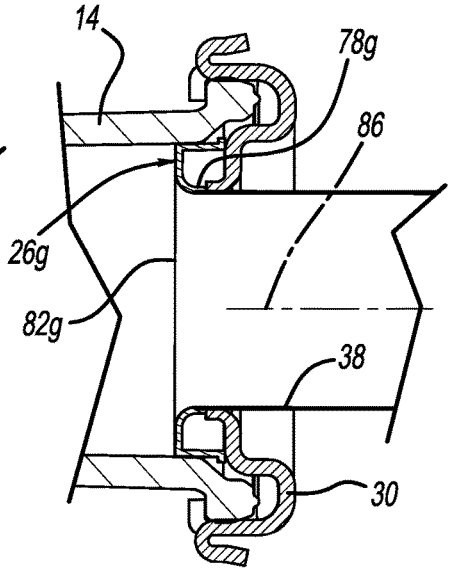
FIG. 9 is a sectional view of the heat exchanger assembly of FIG. 8, taken along line 9-9 shown in FIG. 8.

With additional reference to FIGS. 8 and 9, a plurality of first flow guides 26*g* of a seventh construction are illustrated. It is understood that while FIG. 9 illustrates a sectional view illustrating the first flow guides 26*g*, the first flow guides 26*a*-26*f* can have a similar cross section to that shown in FIG. 9. The first flow guides 26*g* can be similar to the first flow guides 26*a*-26*f* (FIGS. 1-7) except as otherwise shown or described herein. Accordingly, similar reference numerals between FIGS. 1-9 denote similar elements, except as otherwise shown or described herein.

In the example provided, base portion 78*g* of the first flow guides 26*g* can extend outward from the first end member 30 generally parallel to the longitudinal axis 86 by a distance Lg that can be similar to distance La (FIG. 2). In an alternative construction, not specifically shown, the distance Lg can be similar to distance Ld such that distance Lg can vary with location relative to the first port 54 (shown in FIGS. 1-6).

Funnel portion 82*g* can extend from opposite sides of the base portion 78*g* by a distance Hg and can be curved to form a peak 90*g*. In the example provided the peak 90*g* is a generally flat plateau, though other configurations can be used, such as a pointed or rounded peak for example. In the example provided, the distance Hg can be similar to distance Ha (FIG. 2) such that the distance Hg is the same for all of the first flow guides 26*g*. In an alternative construction, not specifically shown, Hg can be similar to Hb (FIG. 3) such that Hg can vary with distance from the first port 54 (shown in FIGS. 1-6).

In the example provided, the funnel portion 82*g* can be curved to form a radius R between the base portion 78*g* and the funnel portion 82*g*. While not specifically shown, the radius R can vary depending on application and can vary depending on distance relative to the first port 54 (shown in FIGS. 1-6). In the example provided, the radius R curves from being tangent to the tube 38 to being tangent with the peak 90*g*. Thus, the distance Hg can depend on the radius R. Opposing sides of adjacent funnel portions 82*g* can generally form a funnel that can expand with increased distance from the first end member 30. While not specifically shown, the first flow guides 26*g* can also include a plurality of vanes similar to vanes 94 (FIG. 6).

Figure 10:
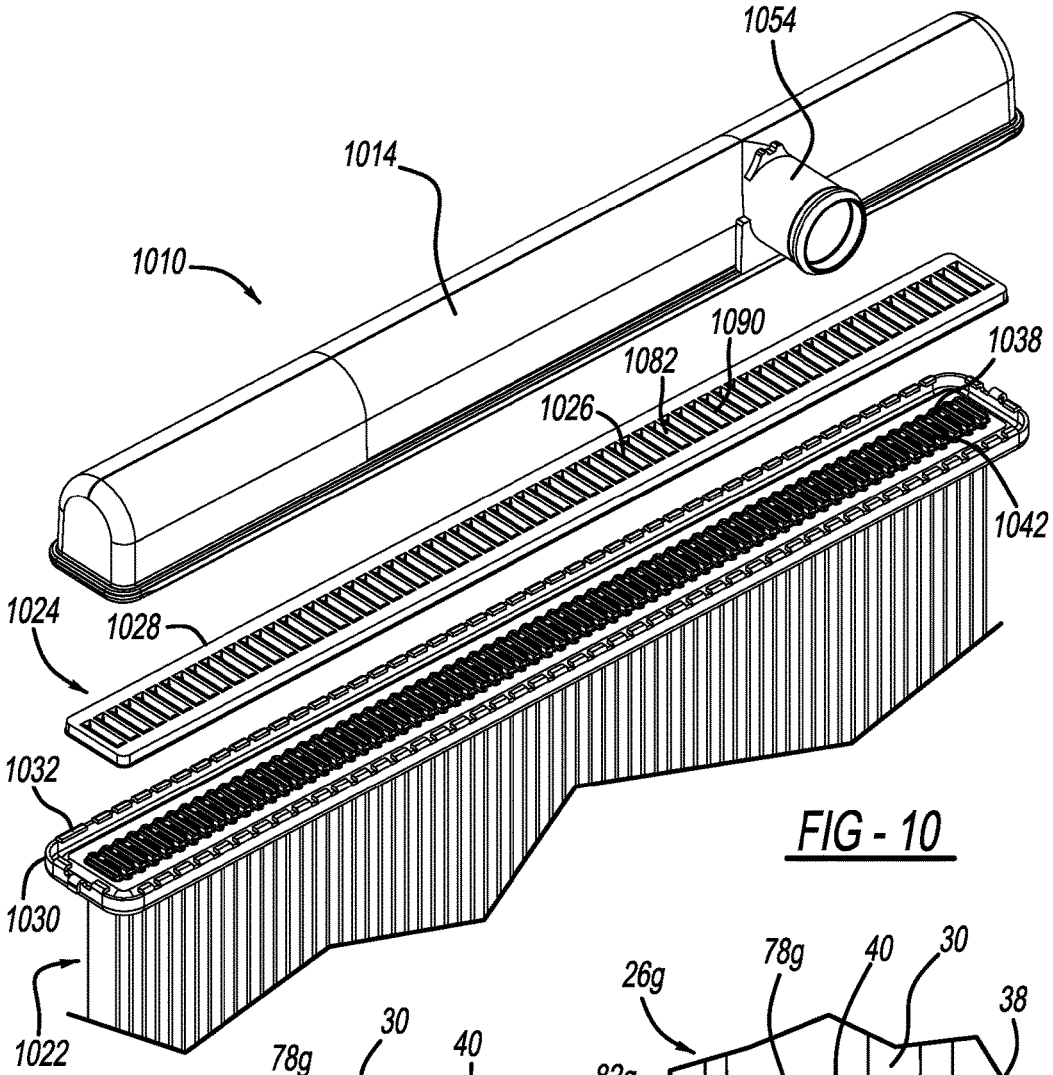
FIG. 10 is an exploded perspective view of a portion of a heat exchanger assembly, illustrating an insert body in accordance with the present disclosure.

With additional reference to FIG. 10, an exploded view of a portion of a heat exchanger 1010 is illustrated. The heat exchanger 1010 can be similar to the heat exchanger 10 (FIGS. 1-9) except as otherwise shown or described herein. The heat exchanger 1010 can include an insert body 1024 that can be located between a first tank 1014 and a first end member 1030 of a core 1022 of the heat exchanger 1010. The first tank 1014, core 1022, and first end member 1030 can be similar to the first tank 14, core 22, and first end member 30 of FIGS. 1-9. The insert body 1024 can be a unitary body that can have a periphery 1028 and can include a plurality of first flow guides 1026. The insert body 1024 can be fixedly coupled to the first tank 1014, and/or the first end member 1030 in any suitable manner such as by brazing, welding, adhesive, fasteners, or press-fit for example. Alternatively, the first tank 1014 and the first end member 1030 can cooperate to sandwich the insert body 1024 therebetween and hold the insert body 1024 in place relative to the tubes 1038.

The periphery 1028 can extend about the first flow guides 1026 and can be located generally between tubes 1038 and a periphery 1032 of the first end member 1030. The first flow guides 1026 can be generally similar to the first flow guides 26*a*-26*g* (FIGS. 1-9) and can have similar cross-sections to those shown in FIGS. 2-9. In this way, the first flow guides 1026 can have a plurality of base portions (not specifically shown) and funnel portions 1082 that form a plurality of peaks 1090, similar to base portions 78*a*-78*g* (FIGS. 2-9), funnel portions 82*a*-82*g* (FIGS. 2-9), and peaks 90*a*-90*g* (FIGS. 2-9). While not specifically shown, the first flow guides 1026 can also include a plurality of vanes similar to the vanes 94 described above with reference to FIG. 6. Adjacent first flow guides 2026 can be fixedly coupled together and to the periphery 1028, and can be positioned to funnel the first fluid (not specifically shown) to an individual one of the tubes 1038.

Figure 11:
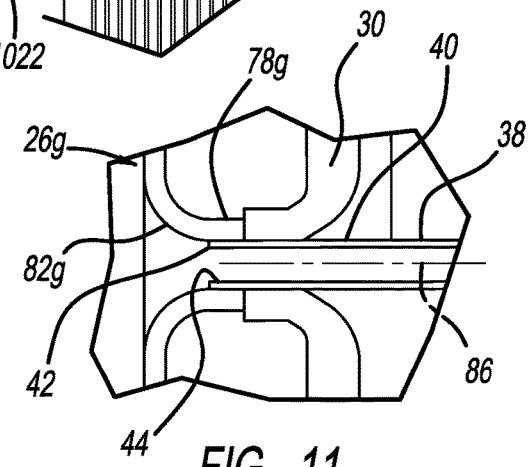
FIG. 11 is a sectional view of a portion of the heat exchanger assembly of FIG. 8, illustrating a first configuration of an interface between a tube and a funnel of the heat exchanger assembly.
Figure 12:
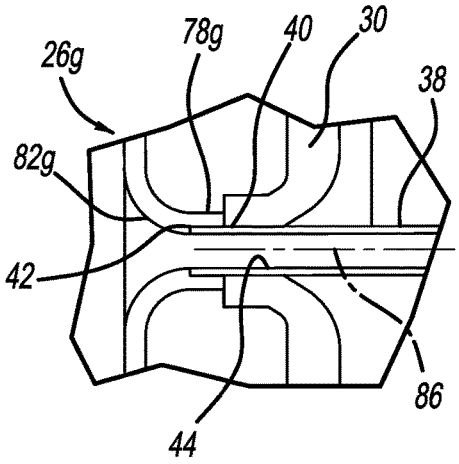
FIG. 12 is a sectional view similar to FIG. 11, illustrating a second configuration of the interface between the tube and the funnel of the heat exchanger assembly.

With additional reference to FIGS. 11 and 12, alternative configurations of an interface between adjacent first flow guides 26*g* (described above with reference to FIGS. 8 and 9) and corresponding terminal ends 42 of tubes 38 are illustrated. While illustrated with reference to the first flow guides 26*g*, it is understood that the interfaces can be similar for any of the first flow guides 26*a*-26*g*, or 1026 (FIGS. 1-10). FIG. 11 illustrates a first construction where the base portion 78*g* is seated outward of an outer surface 40 of the tube 38 such that an inner surface 44 of the tube 38 is not flush with the base portion 78*g* and the funnel portion 82*g*. In this configuration, the tube 38 does not transition smoothly to the funnel portion 82*g*. FIG. 12 illustrates a second construction where the base portion 78*g* is seated with the tube 38 partially recessed relative to the base portion 78*g* such that the inner surface 44 of the tube 38 is flush with and smoothly transitions to the funnel portion 82*g*.

Figure 13:
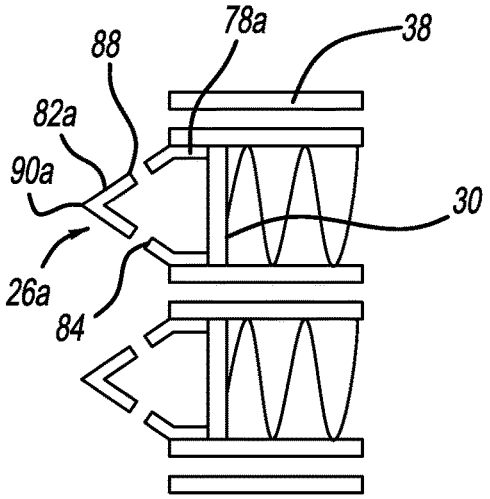
FIG. 13 is a sectional view of a portion of the heat exchanger assembly of FIG. 2, illustrating an optional set of anti-stagnation apertures of the flow guides.

With additional reference to FIG. 13, an alternative configuration of the first flow guides 26*a* (described above with reference to FIG. 2) is shown. In this configuration opposite sides of the funnel portions 82*a* can define apertures 84 and 88 that can fluidly couple adjacent funnels through the first flow guides 26*a*. In this way, when pressure in one of the tubes 38 inhibits flow into that tube 38, fluid flowing into the funnel that corresponds with that tube 38 can pass through the apertures 84, 88 to an adjacent one of the tubes 38. Thus, the apertures 84, 88 can prevent stagnation of fluid between adjacent first flow guides 26*a*. While illustrated and described herein with reference to the first flow guides 26*a*, it is understood that the first flow guides 26*b*-26*g*, and 1026 can include similar apertures 84, 88.

Figure 14:
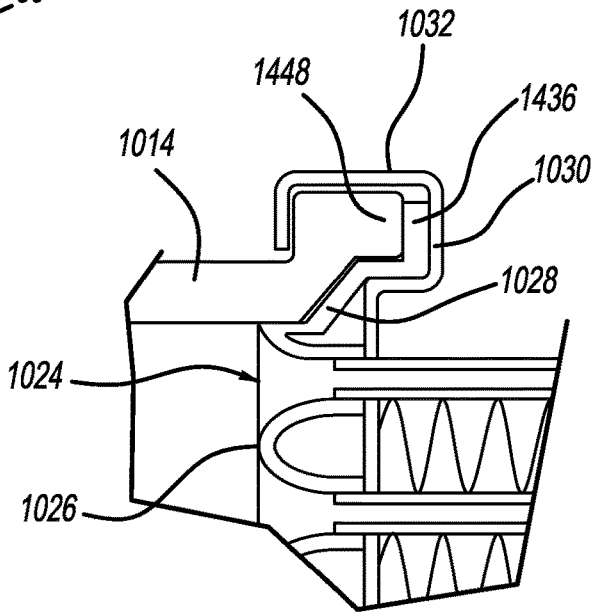
FIG. 14 is a sectional view of a portion of the heat exchanger assembly of FIG. 10, illustrating an optional peripheral seal of the insert body.

With additional reference to FIG. 14, an alternative construction of the insert body 1024 (described above with reference to FIG. 10) is shown. In this construction, the periphery 1028 includes a seal portion 1436 that extends between the periphery 1032 of the first end member 1030 and a periphery 1448 of the first tank 1014. The periphery 1032 of the first end member 1030 can wrap around three sides of the periphery 1448 of the first tank 1014 to fixedly couple the first end member 1030 and the first tank 1014. In the example provided, the periphery 1032 is crimped to the periphery 1448, though other configurations can be used. The seal portion 1436 can be sandwiched between the peripheries 1032 and 1448 to form a seal therebetween. While illustrated and described herein with reference to the first flow guides 1026, it is understood that the first flow guides 26*a*-26*g* can be similarly constructed.

While the periphery 1028 and seal portion 1436 are illustrated as being unitarily formed of the same material as the flow guides 1026 (i.e. the insert body 1024 is a single piece of material), other configurations can be used. For example, the periphery 1028 and/or the seal portion 1436 can be constructed of a different material from the rest of the insert body 1024. In one such configuration, the periphery 1028 and/or the seal portion 1436 can be crimped, overmolded, or co-molded to the rest of the insert body 1024 to form a single assembly.

Figure 15:
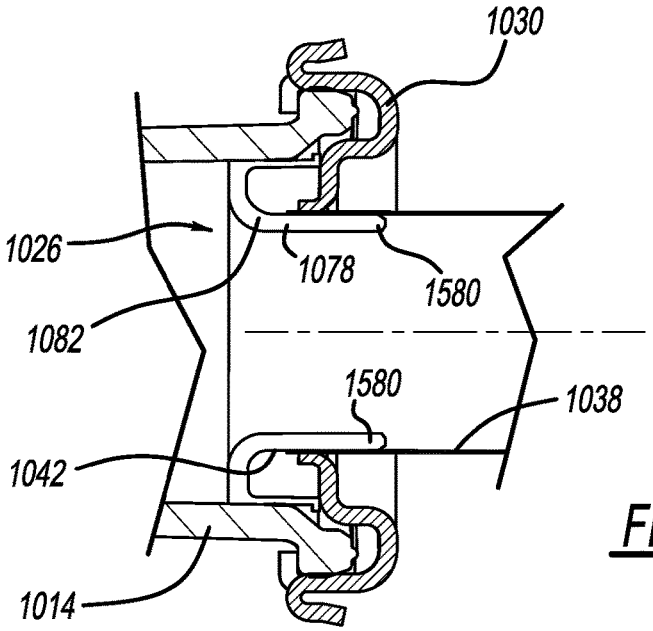
FIG. 15 is a sectional view of a portion of the heat exchanger assembly of FIG. 10, illustrating optional tube support pins.

With additional reference to FIG. 15, a sectional view similar to the sectional view of FIG. 9 illustrates a portion of the heat exchanger 1010 having an alternative construction of the insert body 1024. In this construction, the insert body 1024 can also include a plurality of support pins 1580. In the example provided, two support pins 1580 can extend from the insert body 1024 between adjacent ones of the first flow guides 1026. The support pins 1580 can extend generally from the base portions 1078 and into the interior of the tubes 1038. The support pins 1580 can abut or line opposite sides of the interior of the tube 1038. The support pins 1580 can extend into the tubes 1038 to align the insert body 1024 with the tubes 1038 and to prevent collapse of the terminal ends 1042 of the tubes 1038. The number and location of the support pins 1580 can be determined based on the application. For example, a pair of support pins 1580 can be received in each tube 1038, or only in select tubes 1038.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A heat exchanger comprising:

a core body including a first end member, a second end member, and a plurality of tubes that extend longitudinally between the first and second end members;

a first tank fixedly coupled to the first end member, the first tank including a first port, the first tank and first end member defining a first chamber in fluid communication with the first port and a first end of the tubes;

a second tank fixedly coupled to the second end member, the second tank including a second port, the second tank and second end member defining a second chamber in fluid communication with the second port and a second end of the tubes; and a first set of guide members coupled to the first end member, the first set of guide members cooperating to define a plurality of first funnels, a narrow end of each first funnel being open to an individual one of the tubes, a wide end of each first funnel being open to the first chamber;

wherein the first set of guide members includes a first guide member and a second guide member, the first guide member extending into the first tank a greater distance from the first end member than the second guide member; and wherein the first guide member includes a first wall and a second wall having different lengths and joined at a peak, the first wall is different from the second wall, the first guide member is asymmetrical about a plane that extends along a width of the peak and extends parallel to a length direction of the tubes.

2. The heat exchanger of claim 1, wherein each of the first and second guide members have a pair of base walls that are parallel to the tubes, and a funnel portion that joins the base walls of the respective first or second guide member at the peak, wherein the base walls of the first guide member are longer than the base walls of the second guide member.

3. The heat exchanger of claim 1, wherein each of the guide members of the first set of guide members includes a pair of base walls and a funnel portion that joins the base walls of the respective guide members at peaks thereof, the base walls being flush with an interior surface of the tubes.

4. The heat exchanger of claim 1, further comprising a seal fixedly coupled to the first set of guide members and extending about a perimeter of the first set of guide members, the seal engaging the first tank and the first end member to form a seal there between.

5. An insert for a heat exchanger having a first tank, a second tank, and a core including a plurality of tubes that extend between the first and second tanks, the insert comprising:

a main body defining a plurality of funnels, the main body being configured to be received within the heat exchanger between the first tank and the core, each of the funnels being configured to align with one of the tubes and expanding from a narrow aperture proximate to one of the tubes to a wide aperture proximate to the tank to fluidly couple the tubes to the tank;

wherein the main body includes a plurality of guide members that cooperate to define the funnels and define a peak between each of the funnels, the peak of a first one of the guide members being a greater distance from the narrow aperture than the peak of a second one of the guide members; and wherein at least the first guide member of the plurality of guide members includes a first wall and a second wall having different lengths and joined at the peak of the first guide member, the first wall is different from the second wall, the first guide member is asymmetrical about a plane that extends along a width of the peak and extends parallel to a length direction of the plurality of tubes.

6. The insert of claim 5, further comprising a seal fixedly coupled to the main body and extending about a perimeter of the main body, the seal being configured to engage the first tank and the core to form a seal therebetween.

7. An insert for a heat exchanger having a first tank, a second tank, and a core including a plurality of tubes that extend between the first and second tanks, the insert comprising:

a main body including a plurality of guide members configured to be received within the heat exchanger between the first tank and the core, adjacent guide members cooperating to define a funnel having a narrow aperture that opens into one of the tubes, and a wide aperture that opens into the tank to fluidly couple the tubes to the tank;

wherein a distance between the narrow aperture and the wide aperture increases with decreased proximity to an inlet/outlet of the first tank; and wherein at least a first guide member of the plurality of guide members includes a first wall and a second wall having different lengths and joined at a peak of the first guide member, the first wall is different from the second wall, the first guide member is asymmetrical about a plane that extends along a width of the peak and extends parallel to a length direction of the plurality of tubes.

* * * * *